US009764186B2

(12) United States Patent
Dalebout et al.

(10) Patent No.: US 9,764,186 B2
(45) Date of Patent: Sep. 19, 2017

(54) ROWING MACHINE HAVING A BEAM WITH A HINGE JOINT

(71) Applicant: ICON Health & Fitness, Inc., Logan, UT (US)

(72) Inventors: William T. Dalebout, North Logan, UT (US); Gaylen Ercanbrack, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/952,066

(22) Filed: Nov. 25, 2015

(65) Prior Publication Data

US 2016/0144223 A1 May 26, 2016

Related U.S. Application Data

(60) Provisional application No. 62/085,191, filed on Nov. 26, 2014.

(51) Int. Cl.

| | |
|---|---|
| ***A63B 69/06*** | (2006.01) |
| ***A63B 22/00*** | (2006.01) |
| ***A63B 21/00*** | (2006.01) |

(52) U.S. Cl.

CPC ..... *A63B 22/0076* (2013.01); *A63B 21/154* (2013.01); *A63B 69/06* (2013.01);

(Continued)

(58) Field of Classification Search

CPC ..... A63B 22/0015; A63B 22/0017; A63B 22/0023; A63B 22/0046; A63B 22/0048; A63B 22/0076; A63B 22/0087; A63B 22/0089; A63B 2022/002; A63B 2022/0079; A63B 2022/0082; A63B 2022/0084; A63B 69/06; A63B 69/08; A63B 2069/062; A63B 2069/064; A63B 2069/066; A63B 2069/068;

(Continued)

(56) References Cited

U.S. PATENT DOCUMENTS 1,205,426 A * 11/1916 Barnhill ..... A63B 22/0087 482/72

3,394,934 A 7/1968 Petros et al.

(Continued)

FOREIGN PATENT DOCUMENTS

| | | |
|---|---|---|
| GB | 2327621 | 2/1999 |
| JP | 2003-180899 | 7/2003 |

OTHER PUBLICATIONS

European Search Report for corresponding European Patent Application No. 15196354.3; dated Apr. 8, 2016, 10 pages.

(Continued)

*Primary Examiner* — Joshua Lee
(74) *Attorney, Agent, or Firm* — Holland & Hart LLP

(57) ABSTRACT

A rowing machine includes a frame where the frame includes a first support, a second support, and a beam extending between the first support and the second support. A track is defined by at least a portion of the beam, and a sliding member is movably disposed on the track. A hinge joint is disposed in the beam between the first support and the second support defining a first section of the beam and a second section of the beam.

20 Claims, 6 Drawing Sheets

(52) U.S. Cl.
CPC ..... *A63B 22/0046* (2013.01); *A63B 22/0087* (2013.01); *A63B 2022/0079* (2013.01); *A63B 2069/062* (2013.01); *A63B 2210/50* (2013.01)

(58) Field of Classification Search
CPC ..... A63B 71/0054; A63B 2071/0063; A63B 2071/0072; A63B 2210/00; A63B 2210/50; A63B 2210/52; A63B 2210/54; A63B 2210/56
See application file for complete search history.

(56) References Cited

U.S. PATENT DOCUMENTS

| | | | | |
|---|---|---|---|---|
| 4,421,307 | A | 12/1983 | Cunnington et al. | |
| 4,746,112 | A | 5/1988 | Fayal | |
| 5,707,322 | A † | 1/1998 | Dreissigacker | |
| 5,916,069 | A * | 6/1999 | Wang | A63B 21/153 482/57 |
| 5,938,571 | A | 8/1999 | Stevens | |
| 6,682,462 | B1 * | 1/2004 | Lee | A63B 21/154 482/62 |
| 6,749,546 | B2 | 6/2004 | Yang | |
| 6,926,647 | B1 | 8/2005 | Johnson | |
| 7,381,164 | B2 * | 6/2008 | Smith | A63B 22/0023 482/72 |
| 7,455,626 | B2 † | 11/2008 | Trevino | |
| 7,862,484 | B1 | 1/2011 | Coffey | |
| 2005/0272568 | A1 | 12/2005 | Wang et al. | |
| 2007/0142175 | A1 † | 6/2007 | Morgan | |
| 2008/0188358 | A1 * | 8/2008 | Kuo | A63B 22/0235 482/54 |
| 2009/0069159 | A1 * | 3/2009 | Wang | A63B 22/0235 482/54 |
| 2014/0194260 | A1 | 7/2014 | Campanaro et al. | |

OTHER PUBLICATIONS

R100 APM Premier Rower Owner's Manual, Apr. 13, 2012, Infiniti.com.au.†

* cited by examiner
† cited by third party

ROWING MACHINE HAVING A BEAM WITH A HINGE JOINT

RELATED APPLICATIONS

This application claims priority to U.S. patent application Ser. No. 62/083,191 titled "Rowing Machine Having a Beam with a Hinge Joint" and filed on 26 Nov. 2014, which application is herein incorporated by reference for all that it discloses.

BACKGROUND

A rowing machine is a machine used to simulate a rowing action and is often used to exercise muscles in the legs, arms, core and back. Such rowing machines can be used to develop strength to enhance one's ability to row in the convenience of their homes without having to be in a boat on a body of water. Generally, the rowing machine includes handles which are positioned to be pulled towards the user to simulate a rowing action. Some types of rowing machines have a seat that can slide along a track. The user may sit on the seat and slide the seat forward as he or she begins the rowing action. During a stroke of the rowing action, the user pulls the handles with his back, arms and legs simultaneously while sliding the seat backward. The user then returns the seat and handles to the forward position to initiate another stroke. Such a rowing action provides the user with a full body workout.

One type of rowing machine is disclosed in U.S. Patent Publication No. 2005/0272568 issued to Leao Wang, et al. In this reference, a foldable rowing machine has a base, a sliding seat bar, and a wire-winding wheel. A resistance mechanism box extending from the base cooperates with an upright post to receive a rotating shaft in a shaft hole for rotatably supporting the sliding seat bar and the wire-winding wheel. Accordingly, in rotating the sliding seat upwardly and downwardly on the rotating shaft, the sliding seat bar is foldable in a storage and an operational position, respectively. Another type of rowing machine is described in U.S. Pat. No. 6,749,546 issued to Lien-chaun Yang. Each of these references is herein incorporated by reference for all that they contain.

SUMMARY

In one aspect of the invention, a rowing machine has a frame.

In one aspect of the invention, the frame includes a first support, a second support, and a beam extending between the first support and the second support.

In one aspect of the invention, the rowing machine includes track defined by at least a portion of the beam.

In one aspect of the invention, the rowing machine includes a sliding member movably disposed on the track.

In one aspect of the invention, the rowing machine includes a hinge joint disposed in the beam between the first support and the second support defining a first section of the beam and a second section of the beam.

In one aspect of the invention, the rowing machine further comprises an operating position where a first length of the first section of the beam is aligned with a second length of the second section of the beam.

In one aspect of the invention, a first face of the first section of the beam abuts a second face of the second section of the beam when the rowing machine is in the operating position.

In one aspect of the invention, the rowing machine further comprises a storage position where the first length of the first section of the beam is transverse with respect to the second section of the beam.

In one aspect of the invention, the first section of the beam is pivoted upwards in the storage position when the rowing machine is in an upright position.

In one aspect of the invention, both the first section and the second section are arranged to tilt upwards in the storage position.

In one aspect of the invention, a pull mechanism is attached to the second section, the pull mechanism includes a pull handle.

In one aspect of the invention, a resistance mechanism is arranged to resist movement of the pull handle.

In one aspect of the invention, the pull handle is connected to the resistance mechanism through a cable.

In one aspect of the invention, the rowing machine comprises a dampener comprises a first end attached to the first section of the beam and a second end attached to the second section of the beam.

In one aspect of the invention, the first section or the second section of the beam comprise a fold handle positioned adjacent the hinge joint.

In one aspect of the invention, both the first section and the second section are arranged to tilt upwards in response to an upward force applied to the fold handle when the rowing machine is in an upright position.

In one aspect of the invention, a rowing machine has a frame.

In one aspect of the invention, the frame includes a first support, a second support, and a beam extending between the first support and the second support.

In one aspect of the invention, the rowing machine includes track defined by at least a portion of the beam.

In one aspect of the invention, the rowing machine includes a sliding member movably disposed on the track.

In one aspect of the invention, the rowing machine includes a hinge joint disposed in the beam between the first support and the second support defining a first section of the beam and a second section of the beam.

In one aspect of the invention, the rowing machine comprises an operating position where a first length of the first section of the beam is aligned with a second length of the second section of the beam.

In one aspect of the invention, the rowing machine comprises a storage position where the first length of the first section of the beam is transverse with respect to the second section of the beam.

In one aspect of the invention, the first section of the beam is pivoted upwards in the storage position when the rowing machine is in an upright position.

In one aspect of the invention, both the first section and the second section are arranged to tilt upwards in the storage position.

In one aspect of the invention, a pull mechanism is attached to the second section where the pull mechanism includes a pull handle.

In one aspect of the invention, a resistance mechanism is arranged to resist movement of the pull handle.

In one aspect of the invention, the pull handle is connected to the resistance mechanism through a cable.

In one aspect of the invention, the rowing machine includes a dampener that includes a first end attached to the first section of the beam and a second end attached to the second section of the beam.

In one aspect of the invention, the first section or the second section of the beam comprises a fold handle positioned adjacent the hinge joint.

In one aspect of the invention, both the first section and the second section are arranged to tilt upwards in response to an upward force applied to the fold handle when the rowing machine is in an upright position.

In one aspect of the invention, a rowing machine has a frame.

In one aspect of the invention, the frame includes a first support, a second support, and a beam extending between the first support and the second support.

In one aspect of the invention, the rowing machine includes track defined by at least a portion of the beam.

In one aspect of the invention, the rowing machine includes a sliding member movably disposed on the track.

In one aspect of the invention, the rowing machine includes a hinge joint disposed in the beam between the first support and the second support defining a first section of the beam and a second section of the beam.

In one aspect of the invention, the rowing machine includes an operating position where a first length of the first section of the beam is aligned with a second length of the second section of the beam.

In one aspect of the invention, the rowing machine includes a storage position where the first length of the first section of the beam is transverse with respect to the second section of the beam.

In one aspect of the invention, a pull mechanism is attached to the second section, the pull mechanism includes a pull handle.

In one aspect of the invention, a resistance mechanism is arranged to resist movement of the pull handle.

In one aspect of the invention, the pull handle is connected to the resistance mechanism through a cable.

In one aspect of the invention, a dampener comprises a first end attached to the first section of the beam and a second end attached to the second section of the beam.

In one aspect of the invention, the first section or the second section of the beam comprises a fold handle positioned adjacent the hinge joint.

In one aspect of the invention, both the first section and the second section are arranged to tilt upwards in response to an upward force applied to the fold handle when the rowing machine is in an upright position.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

The principles described herein include a rowing machine that has a frame with a beam extending between a first support and a second support. At least a portion of the beam has a track along which a sliding member is arranged to travel. The sliding member may be a seat or another type of member. The beam also has a hinge joint separating a first section of the beam and a second section of the beam. The first section of the beam is configured to pivot about the hinge joint with respect to the second section of the beam. When the rowing machine is in an operational position, the first section of the beam may be oriented such that first section and the second section are aligned with each other and form a continuous beam. In the storage position, the first section of the beam may be bent about the pivot hinge to reduce the overall floor space occupied by the rowing machine. For example, the first section of the beam may be raised to an upright position to reduce the footprint of the rowing machine when the rowing machine is in a storage position. In other examples, the first beam folds to the side. However, in some cases, both the first and second sections of the beam tilt upwards while staying connected at the pivot joint. In such an example, the first and second sections of the beam may form a "V" shape or be bent back onto each other so that first and second beams are substantially aligned with one another.

For purposes of this disclosure, the term "aligned" may mean parallel, substantially parallel or forming an angle of less than 35 degrees. For purposes of this disclosure, the term "transverse" may mean perpendicular, substantially perpendicular or forming an angle between 55 and 125 degrees.

Figure 1:
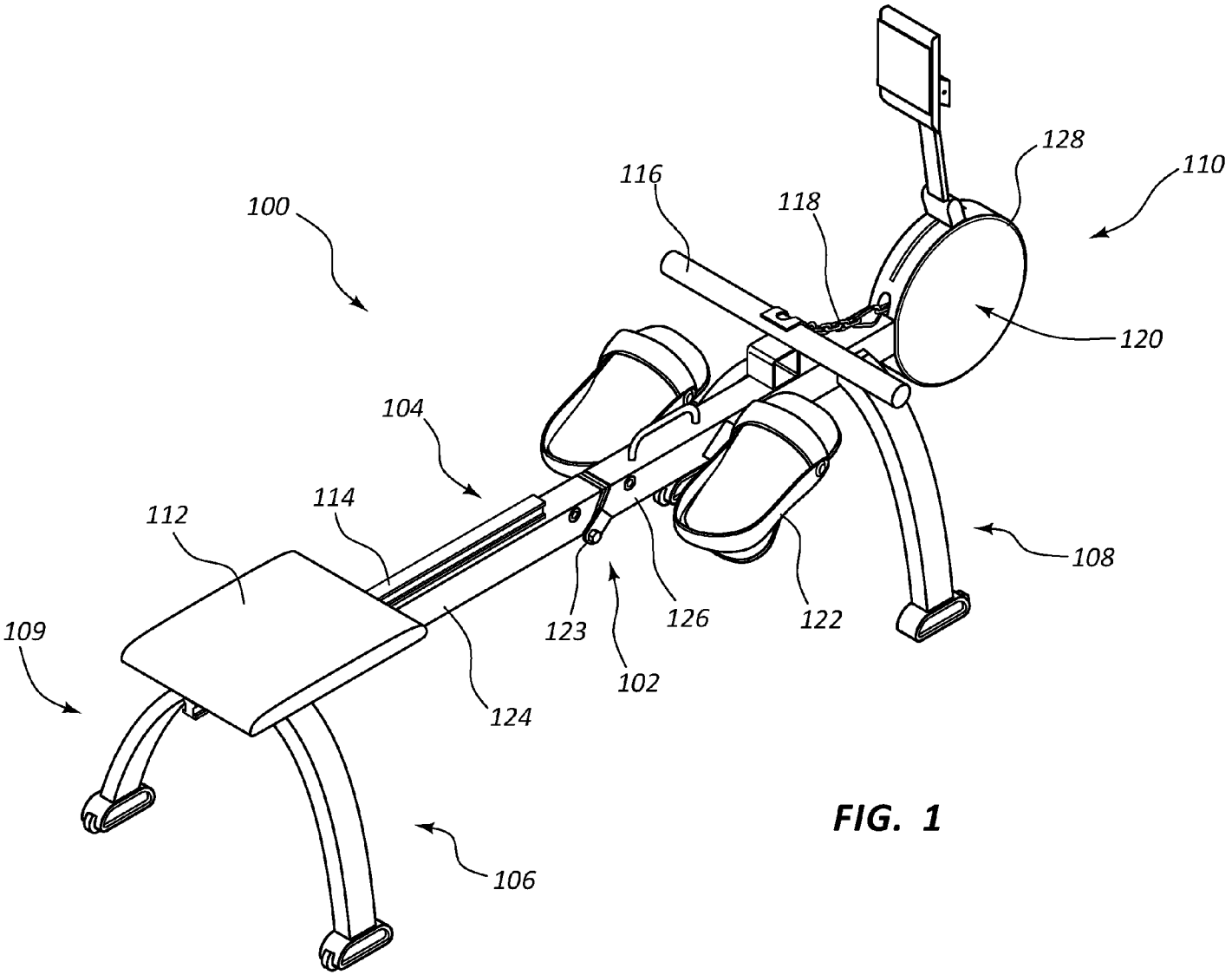
FIG. 1 illustrates a perspective view of an example of a rowing machine in an operating position in accordance with the present disclosure.

Particularly, with reference to the figures, FIG. 1 depicts an example of a rowing machine 100. In this example, the rowing machine 100 includes a frame 102 that includes a beam 104 supported on of a surface (i.e. floor or another type of platform) by at least a first support 106 at a first end 109 of the beam 104 and a second support 108 at a second end 110 of the beam 104. In some examples, the first and/or second support 106, 108 may include one or more legs.

The beam 104 includes a sliding member 112 that is arranged to slide along a track 114 incorporated into a length of the beam 104. The user may sit on the sliding member 112 and thereby move himself or herself along the length of the track 114 during a workout session. The rowing machine 100 also includes a pull handle 116 that the user can pull during the workout. In the illustrated example, the pull handle 116 is connected to a pull cable 118 that is attached to a resistance mechanism 120.

In the illustrated example, as the user desires to operate the rowing machine 100, the user may place his or her feet at foot supports 122 located proximate the resistance mechanism 120. However, in other examples, the foot supports 122 may be located at any appropriate location on the rowing machine 100, such as along the track 114 or in at location space away and apart from the resistance mechanism 120. Any appropriate type of foot support 122 may be used in accordance with the principles described in the present disclosure. For example, a plate may be positioned and angled to support the user's foot when the user is seated on the sliding member 112 and oriented to perform a rowing action. In other examples, the foot support may include a flat or another shape formed on the resistance mechanism, the track 114, the beam, another location of the rowing machine or combinations thereof that can provide the user a stable surface from which to push off of during the rowing action.

The user may use his or her legs to move the user's center of gravity along the track 114 by moving the sliding member 112 back and forth along the length of the beam 104. The user may also grasp the pull handle 116 with his or her hands. To perform a stroke, the user may begin with the sliding member 112 forward, the knees bent and the user's torso leaning forward. The user may simultaneously straighten the legs, pull on the pull handles with his or her arms and lean the torso back until the user is extended as far back as desired. To complete the rowing stroke, the user may move the sliding member back forward, re-bend the knees, lean the torso forward and return the pull handles to their original position which brings the user back to the initial position to where the user is ready to perform another rowing stroke. Such movements may provide the user with a full body workout. The user may perform such movements and other types of movements on the rowing machine 100 while the rowing machine is in an operating position where the first and second sections of the beam are aligned with each other and form a continuous beam. When the rowing machine 100 is not in use, the user may fold the rowing machine 100, so that the rowing machine is more compact and takes up less floor space in the storage position.

A hinge joint 123 connects a first section 124 of the beam 104 to a second section 126 of the beam 104. When in the operating position, the first section 124 and the second section 126 form a continuous beam. In such an operating position, the first section 124 may be aligned with the second section 126. In the storage position, the first section 124 of the beam 104 may be moved such that the first section 124 is transverse to the second section 126. In some examples, the first section 124 folds upwards or to the side. In other examples, both the first and second sections 124, 126 tilt upwards bringing the first and second supports 106, 108 closer together. As the first and second supports 106, 108 are brought closer together, the hinge joint 123 may be elevated higher with respect to the platform or floor supporting the rowing machine 100. In each of these examples, the footprint of the rowing machine 100 condenses as the rowing machine 100 becomes more compact in the storage position. As a result, the rowing machine 100 can take up less floor space.

In some examples, wheels are incorporated into the legs of the first and second supports 106, 108 to reduce the friction between the supports and the floor as the first and second supports 106, 108 move closer together. Such wheels may be positioned adjacent the side of the legs such that when the wheels do not make contact with the floor when the rowing machine 100 is in the operating position, but such that the wheels will make contact with the floor as the legs angle as the first and second supports move closer together.

Any appropriate type of resistance mechanism may be used in accordance with the principles described in the present disclosure. For example, flywheels, springs, magnetic mechanisms, braking mechanisms, hydraulic mechanisms, pneumatic mechanisms, other types of mechanisms or combinations thereof may be used to provide resistance to the movement of the pull cable. In the illustrated example, the resistance mechanism includes a flywheel located within a housing 128. Such a flywheel may be at least partially made of a magnetic material, and the movement of the flywheel may be resisted by a magnetic force imposed by a magnetic unit inside of the housing 128. In some examples, the resistance to the movement of the flywheel is achieved by moving the magnetic unit closer to the flywheel. In yet other examples, the resistance can be adjusted by changing the magnetic force, such as by increasing an electrical current to the magnetic unit, where the electrical current is converted into a magnetic force.

The pull cable 118 may be wrapped around a circumference of the flywheel such that as the pull handle is pulled, the flywheel is caused to rotate in a first direction. A spring mechanism, a counterweight mechanism or another type of mechanism may cause the flywheel to return to its original orientation in the absence of a force from the user. In such examples, as the user reduces the pull force on the handles, the flywheel may return to its original position ready to be rotated again in response to a pull force on the handles.

In other examples, the cable may be wrapped in spool that is connected to the flywheel. In such examples, the spool may share a common rotational axis with the flywheel. The flywheel may rotate with the spool in a first direction when the user is pulling on the pull handle. However, the spool may rotate independent of the flywheel back to its original position as the user returns the pull handle 116 to take up the slack in the cable 118. The spool may return to its original position due to a counterweight, a spring mechanism, another type of mechanism or combinations thereof. In such examples, the flywheel may remain in the orientation left by the user at the end of the user's pull. In such a manner, the flywheel may rotate in just a single direction.

With the flywheel rotating in just a single direction, a sensor may track the number of revolutions made by the flywheel. In some embodiments, the sensor causes a counter to be incremented up one for each rotation of the flywheel. In other embodiments, the sensor can track partial revolutions of the flywheel. Other sensors can track the magnetic resistance applied to the flywheel's rotation.

The tracked level of resistance and the revolution count can be sent to a processor within the rowing machine or remote of the rowing machine. Based on these inputs, the processor can be cause to determine the amount of calories burned during each pull and/or collectively during the course of the entire workout. Further, the force generated by each pull can be calculated as well. In some examples, a transmitter incorporated into the rowing machine 100 may send the calorie count, the revolution count, a calculated force, a speed, a duration of the exercise, another type of information or combinations thereof to a remote device. Such a remote device may be a mobile device, a cloud based device, a networked device, another type of device or combinations thereof. This information may be stored in a database. Such a database may be accessible to the user via the internet, a profile, a network or combinations thereof.

In some examples, other types of information can be determined using the revolution count. For example, the processor may also determine the expected remaining life of the rowing machine based on use. Such a number may be based, at least in part, on the number of flywheel revolutions. Further, the processor may also use the revolution count to track when maintenance should occur on the rowing machine, and send a message to the user indicating that maintenance should be performed on the rowing machine based on usage.

In some examples, the sensor is accompanied with an accelerometer. The combination of the inputs from the accelerometer and the sensor can at least aid the processor in determining the force exerted by the user during each pull. The processor may also track the force per pull, the average force over the course of the workout, the trends of force over the course of the workout and so forth. For example, the processor may cause a graph of force per pull to be displayed to the user. In such a graph, the amount of force exerted by the user at the beginning of the workout verses the end of the workout may be depicted. Such information may be useful to the user and/or a trainer in customizing a workout for the user.

The number of calories burned by the user per pull may be presented to the user in a display incorporated into the rowing machine or the display of a remote device (i.e. mobile device, laptop, etc.). In some examples, the calories for an entire workout are tracked and presented to the user. In some examples, the calorie count is presented to the user through the display, through an audible mechanism, through a tactile mechanism, through another type of sensory mechanism or combinations thereof.

While the example above has been described with specific reference to the pull handle being connected to a pull cable, the pull handles may be connected to any appropriate type of mechanisms to simulate rowing. For example, the pull handle may be part of a bar that is connected underneath the beam. In such an example, the user pulls a bar backwards during the rowing stroke rather than pulling the pull cable. An non-exhaustive list of devices that the pull handles may be connected to include cables, bars, levers, rings, oars, other mechanisms or combinations thereof.

Further, while the rowing machine described above includes the resistance mechanism positioned at an end of the rowing machine, the resistance mechanism may be positioned at an appropriate location in accordance with the principles described in the present disclosure. For example, the resistance mechanism may be located underneath the beam; to the side of the beam; within an attachment to a bar, lever or other device; another location; or combinations thereof.

Figure 2A:
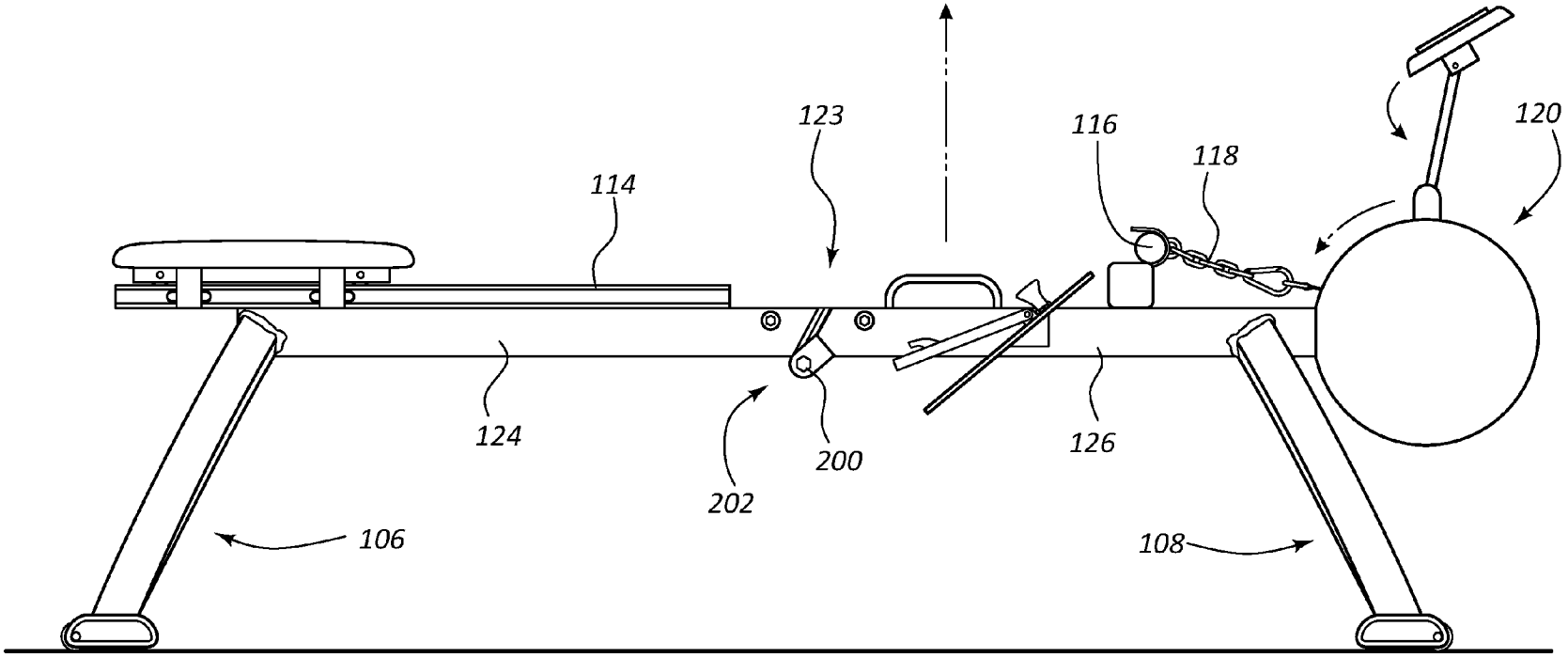
FIG. 2A illustrates a side view of an example of a rowing machine in an operating position in accordance with the present disclosure.
Figure 2B:
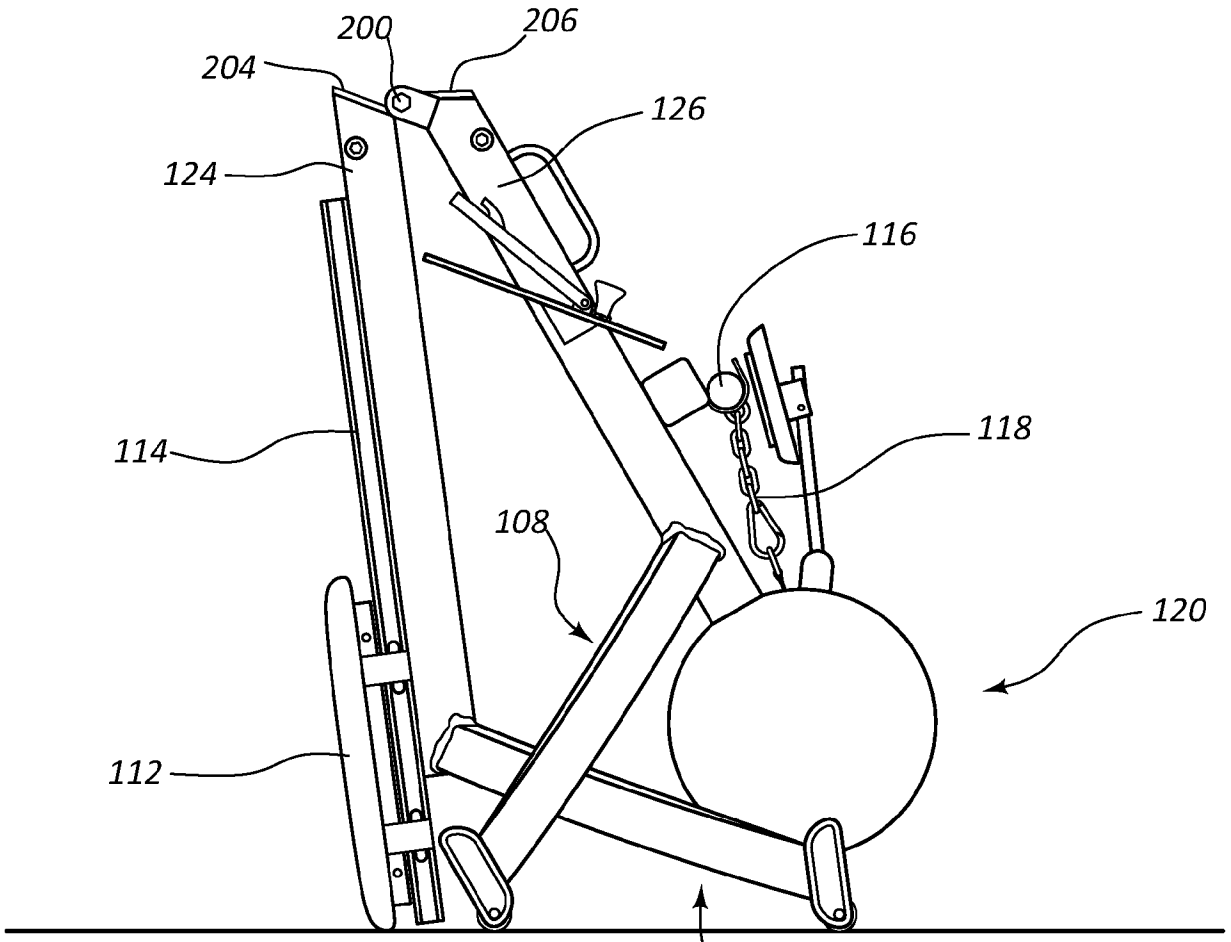
FIG. 2B illustrates a side view of an example of a rowing machine in a storage position in accordance with the present disclosure.

FIGS. 2A-2B illustrate side views of an example of a rowing machine in an operating position and a storage position in accordance with the present disclosure. FIG. 2A depicts the rowing machine 100 in an operating position, and FIG. 2B depicts the rowing machine in a storage position. In this example, both the first section 124 and the second section 126 of the beam 104 are tilted upwards. The hinge joint 123 includes a pivot rod 200 that connects the undersides 202 the first section 124 and the second section 126. As the hinge joint 123 is bent, the first abutting face 204 of the first section 124 separates from the second abutting face 206 of the second section 126 while the bottom sides of the abutting faces 204, 206 remain joined together through the pivot rod 200. In such an example, the first and second supports 106, 108 move closer to one another as the rowing machine is brought into the storage position.

Figure 3:
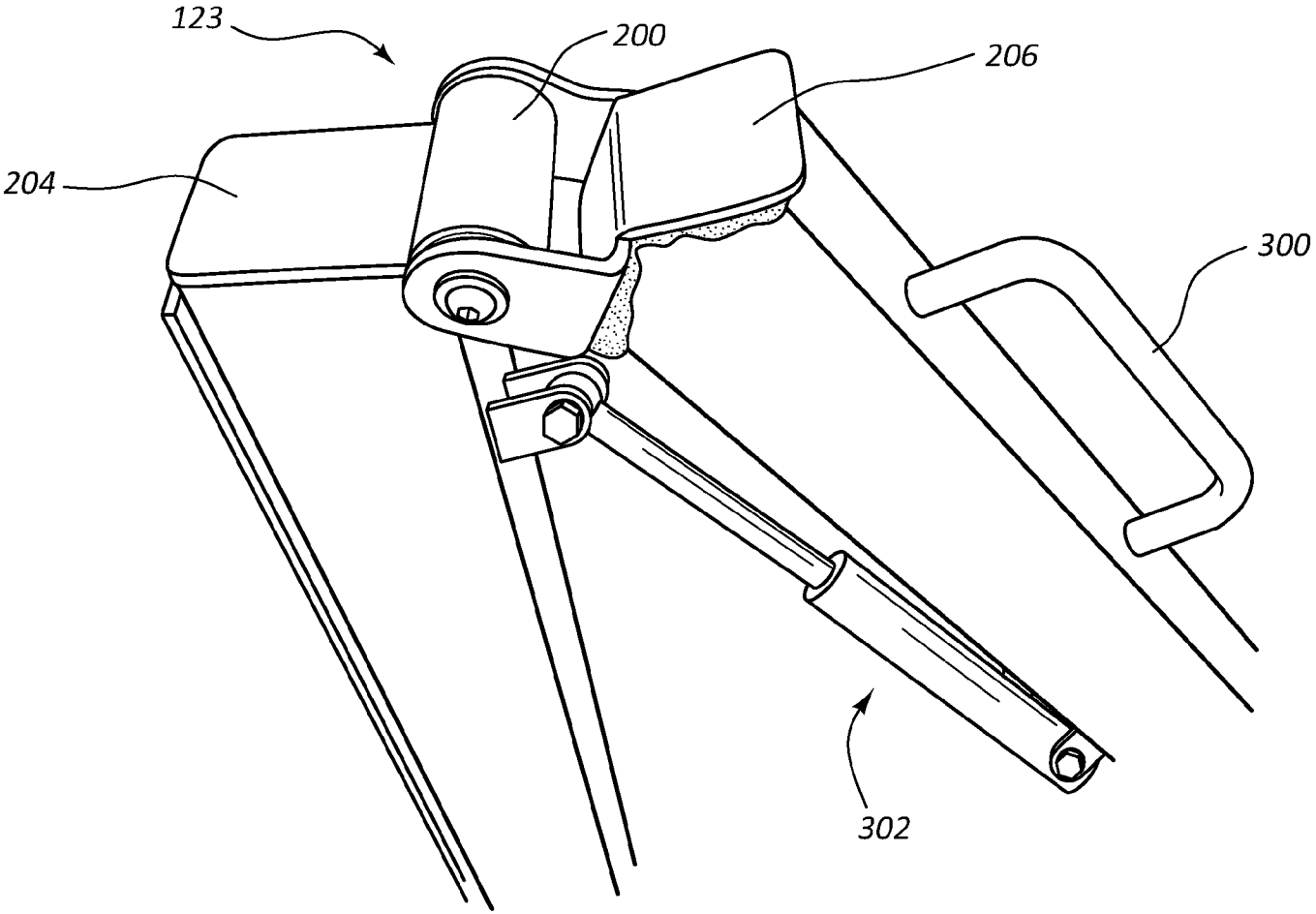
FIG. 3 illustrates a detailed view of an example of a joint in a beam of a rowing machine in accordance with the present disclosure.

FIG. 3 illustrates a detailed view of a pivot joint 123 in a beam 104 of a rowing machine 100 in accordance with the present disclosure. In this example, the pivot rod 200 is connected to the underside 202 of the first and second sections 124, 126 such that the pivot joint 123 opens upwards as the beam 104 is folded into the storage position. In the operating position, the first and second abutting faces 204, 206 may come into contact with one another such that the faces 204, 206 support each under when a load is imposed on the beam 104. For example, when the beam 104 is in the operating position such that the abutting faces 204, 206 are in contact with each other, a user may apply a downward load directly over the pivot joint 123. The load imposed with such a downward force may spread across the surface areas of the first and second abutting faces 204, 206 such that the first and second sections 124, 126 act as a single continuous beam.

On the other hand, an upward force imposed from the underside of the pivot joint 123 may readily cause the pivot joint 123 to open causing the beam 104 to bend at the pivot joint 123. In the illustrated example, a fold handle 300 may be positioned proximate the pivot joint 123 on either the first section 124 or the second section 126. The fold handle 300 may be placed on the top side of the beam 104, the sides of the beam 104, another location of the beam 104 or combinations thereof. The fold handle 300 may be positioned such that an upward force on the fold handle 300 imposes an upward force on the pivot joint 123 causing the pivot joint 123 to open upwards and causing the first and second sections 124, 126 to tilt upwards as well. Thus, the user can cause the rowing machine 100 to collapse into the storage position with a single step of pulling up on the fold handle 300.

The first and second sections 124, 126 may tilt upwards by rocking the first and second supports 106, 108 upwards. In some examples, either of the first or second supports 106, 108 may be shaped to accommodate the first and second section's ability to tilt. For example, rounded corners, other shapes or combinations thereof may be used to accommodate the tilting of the first and second sections 124, 126. Further, wheels, low friction materials, other features, or combinations thereof may be incorporated into the legs of the first and second supports to accommodate the tilting movement.

In the illustrated example, the dampener 302 has a first end attached to the first section 124 and a second end attached to the second section 126. The dampener 302 may be a gas shock that controls how the pivot joint 123 collapses. For example, the dampener 302 may control the speed at which the pivot joint 123 closes or opens. In an example without a dampener 302, a forceful pull on the fold handle 300 may cause the first and second sections 124, 126 to bang together. However, with the dampener 302, such a forceful pull may be met with resistance to the beam 104 bending due to the dampener 302. Such resistance provided by the dampener 302 may prevent the first and second sections 124, 126 from banging together. By reducing and/or eliminating the banging of the first section 124, the second section 126 or other portions of the rowing machine, the dampener 302 protects the rowing machine's components and may result in reducing wear and increasing the life of the rowing machine 100.

In other examples, the dampener 302 may be used to assist with collapsing the beam 104 at the pivot joint 123. In such an example, the user may instruct the rowing machine to collapse through an input mechanism. Receipt of the instructions may cause an actuator to bend the beam 104 at the pivot joint 123. In some circumstances, the actuator may cause the dampener 302 to increase its length to cause the beam 104 to bend, and the actuator may cause the dampener 302 to shorten its length causing the first and second sections 124, 126 to come into alignment with each other. In other examples, the dampener 302 is independent of the actuator that causes the beam 104 to transition into either the storage or operating positions. In examples where the dampener 302 is independent, the dampener 302 may control the speed and stability of how the beam 104 bends into either the storage or operating positions.

While this example has been described with reference to a specific type of dampener, any appropriate type of dampener may be used in accordance with the principles described in the present disclosure. A non-exhaustive list of dampeners that may be used with the rowing machine described in the present disclosure may include gas shocks, hydraulic shocks, compression springs, tension springs, coiled springs, other types of springs, brakes, counterweights, other types of dampening elements or combinations thereof.

Figure 4:
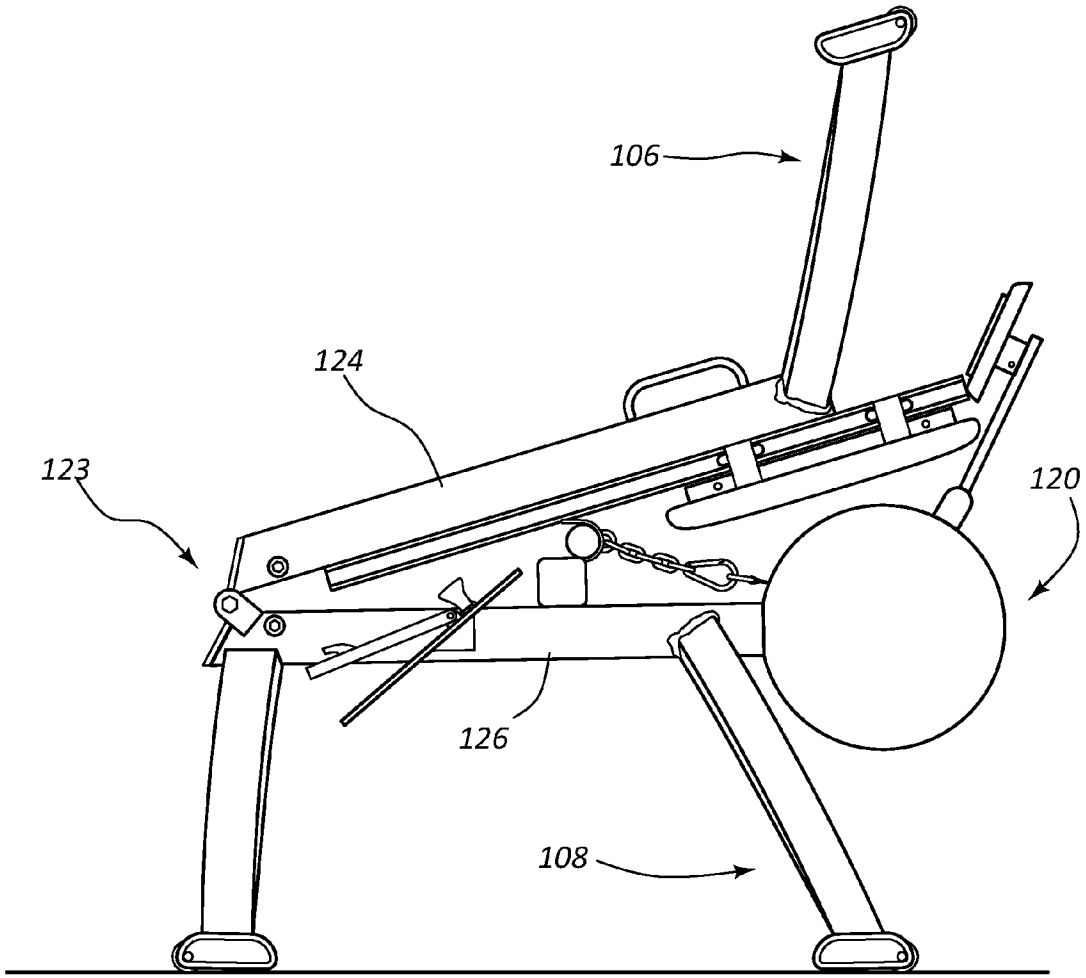
FIG. 4 illustrates a perspective view of an example of a rowing machine in a storage position in accordance with the present disclosure.

FIG. 4 illustrates a perspective view of an example of a rowing machine 100 in a storage position in accordance with the present disclosure. In this example, the first section 124 is configured to pivot into an upright orientation. In such an example, the pivot joint 123 may have the pivot rod located at the top side of the joint, and the pivot joint 123 may open from the bottom side. In such an example, the first section 124 may remain in an upright position while the rowing machine 100 is in the storage position. By merely moving the first section 124 of the beam 104 into the air, the footprint of the rowing machine is reduced freeing up floor space while the rowing machine is not in use.

Figure 5:
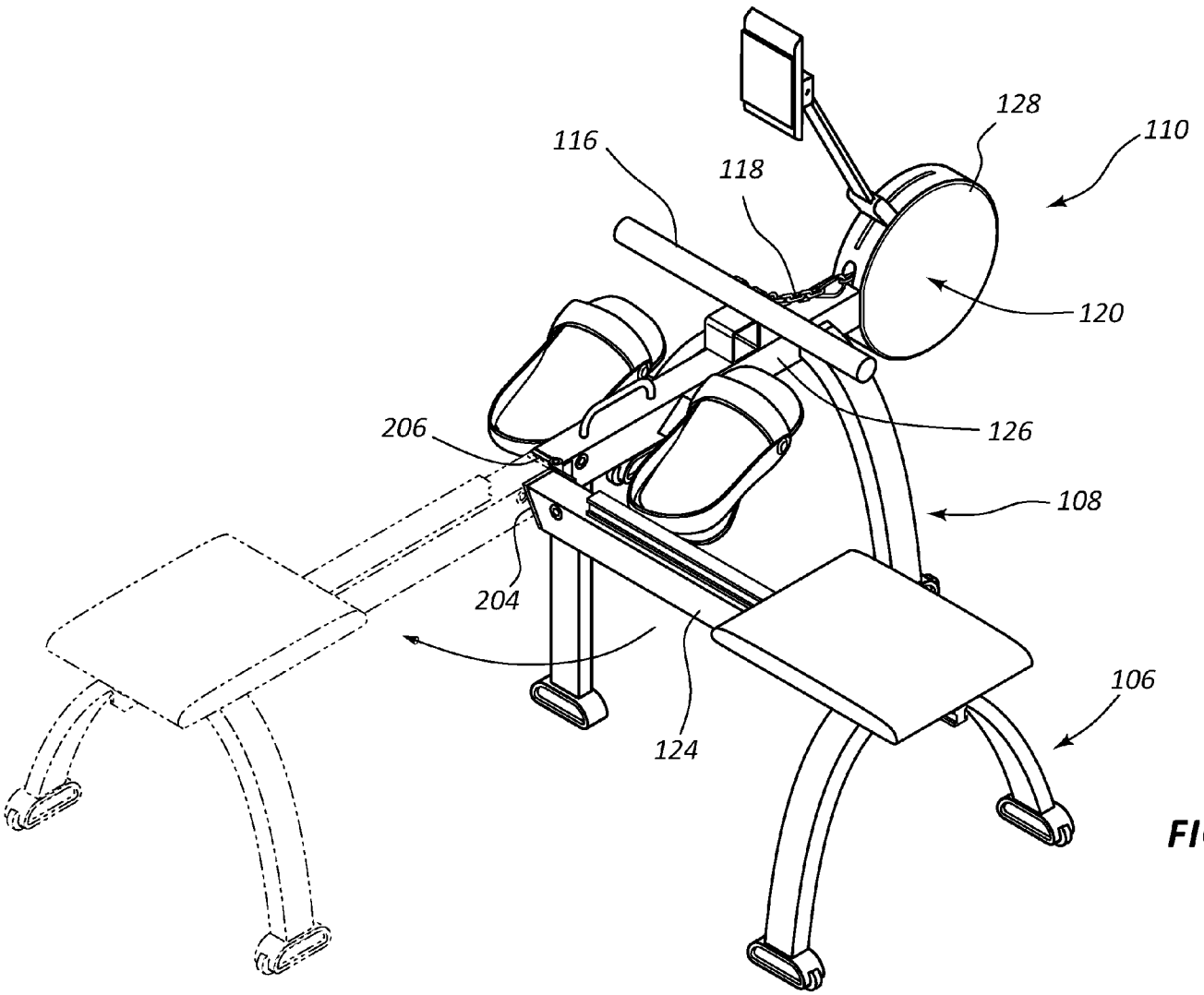
FIG. 5 illustrates a perspective view of an example of a rowing machine in a storage position in accordance with the present disclosure.

FIG. 5 illustrates a perspective view of an example of a rowing machine 100 in a storage position in accordance with the present disclosure. In this example, the first section 124 is pivoted laterally with respect to the second section 126 of the beam 104. By pivoting the first section 124 laterally, the overall length of the rowing machine 100 is reduced thereby freeing up floor space that was previously occupied by the rowing machine 100 when in the operating position.

While the examples above have been described with reference to the pivot joint 123 including specific features, any appropriate type of pivot joint 123 may be used in accordance with the principles described herein. For example, the pivot joint may not include first and second abutting faces 204, 206. In such an example, the pivot joint 123 may include brackets that support the pivot rod. Such brackets may space the pivot rod a distance from the bodies of the first and/or second sections 124, 126 of the beam 104. In some examples, the sliding member may be configured to slide over the pivot joint 123, while in other examples, the track does not pass over the pivot joint 123. In further examples, the pivot rod may be connected to a mid-section of the joint face, rather than just a top or bottom of the joint faces.

In yet other examples, the beam 104 may include other feature to reduce its overall length. For example, portions of the beam 104 may telescopically extend or retract. Additionally, in some examples, the beam 104 may include multiples joints. For example, a first joint may cause a portion of the beam 104 to bend upwards while a second joint causes another portion of the beam 104 to bend laterally.

While the examples above have been described with the pivot joint 123 at specific locations along the beam 104, the pivot joint 123 may be located at any appropriate point between a first end and a second end of the beam 104. For example, the pivot joint 123 may be located exactly at a midpoint of the beam 104 thereby causing the first and section sections 124, 126 to have exactly the same length. In other examples, the pivot joint or joints are located closer to a front end of the beam 104 or to a rear end of the beam 104 resulting in the first and second sections 124, 126 having different lengths. In some examples, at least one of the first section 124 and the second section 126 are at least six inches long. However, in many examples, at least one of the first section 124 and the second section 126 are at least two feet long. However, the first and second sections 124, 126 may include any appropriate length in accordance with the principles described in the present disclosure.

In some examples, the rowing machine 100 includes a locking mechanism that causes the first section 124 to lock with respect to the second section 126 in at least one of the storage position or the operating position. For example, when the first section 124 is brought into alignment with the second section 126 to form a single continuous beam, an replaceable rod may be inserted into first and second openings formed in the first and second sections 124, 126 that are aligned in this orientation. The replaceable rod may prevent the first and second sections 124, 126 of the beam 104 from moving while the rowing machine is in the operating position. Likewise, such a replaceable rod may be inserted into similar openings when the rowing machine 100 is in the storage position to prevent the first section 124 from moving with respect to the second section 126. Any appropriate type of lock may be used in accordance with the principles described in the present disclosure. For example, the locking mechanism may include a spring loaded lock, a magnetic lock, a latch, a cross bar, a hook, a compression mechanism, an elastomeric member, dead bolt, a snapping mechanism, another type of locking mechanism, or combinations thereof.

Also, while the examples above have been depicted with abutting faces 204, 206 having specific angles, any appropriate angle may be used in accordance with the principles described in the present disclosure. In one example, the abutting face angles may be perpendicular to the length of the beam 104. In other examples, such angles are within 55 and 125 degrees with respect to the length of the beam 104.

INDUSTRIAL APPLICABILITY

In general, the invention disclosed herein may provide a user with a rowing machine that has an operating position that is fully expanded and ready for use. The rowing machine also has a storage position that is more compact than the operating position and takes up less floor space. One difference between the operating position and the storage position is that the beam, along which a sliding member can travel, is folded such that the beam has an overall shortened length in the storage position. In such an arrangement, a portion of the beam may continue to have the same orientation in the storage position as that section had in the operating position with respect to at least one of the resistance mechanism, the foot supports, the second supports, another portion of the rowing machine or combinations while another portion of the beam has a different orientation in the storage position than it had during the operating position.

In some cases, the portion of the beam that is connected to the resistance mechanism remains in the same orientation during both the storage and the operating position. In other examples, the portion of the beam that is connected to the resistance mechanism moves with respect to the floor causing the resistance mechanism to move during the storage position.

Any appropriate type of joint may be used to cause the beam to bend. In one examples, the joint causes the first section of the beam to fold upwards. In another example, the joint causes the first section of the beam to fold laterally. In yet another example, the joint is shaped such to cause both of the beam sections to tilt upwards.

In some cases, the joint is constructed such that the beams own weight pushes the faces of the pivot joint to abut one another and thereby support each other under the load. In such an example, the first and second abutting faces support each other while the beam is extend in the operating position. As such, the beam acts as a continuous beam. However, upward forces on the beam may cause the pivot joint to bend allowing for the beam to collapse and allowing the rowing machine to transition from the operating position to the storage position in a single step.

In some cases, a locking mechanism may be used to secure the first and second sections of the beam in their orientations in at least one of the operating position and the storage position. For example, the user may use a locking mechanism to lock the first and second beams in place during the operating position. Likewise, a locking mechanism may be used to cause the first and second beams to lock in place during the storage position. The locking mechanism may include a removable rod that can be inserted into openings of the first and second sections of the beam at the same time. In other examples, the locking mechanism automatically causes the first and second sections to be locked into place once the first and second sections are brought into place in either the storage position and/or the operating position.

What is claimed is:

1. A rowing machine, comprising:

a frame, wherein the frame includes a first support, a second support, and a beam extending between the first support and the second support;

a track defined by at least a portion of the beam;

a sliding member movably disposed on the track;

a hinge joint disposed in the beam between the first support and the second support defining a first section of the beam and a second section of the beam; and a leg connected to the beam adjacent to the hinge joint;

wherein the first section of the beam is configured to pivot upwards such that the first section is over the hinge joint when the rowing machine is in a storage position and wherein the leg supports a weight of the upwardly pivoted first section and at least a portion of the second section.

2. The rowing machine of claim 1, further comprising an operating position where a first length of the first section of the beam is aligned with a second length of the second section of the beam.

3. The rowing machine of claim 2, wherein a first face of the first section of the beam abuts a second face of the second section of the beam when the rowing machine is in the operating position.

4. The rowing machine of claim 2, further comprising a storage position where the first length of the first section of the beam is transverse with respect to the second section of the beam.

5. The rowing machine of claim 1, wherein the leg and the second support maintain a consistent distance from each other in both an operating position and the storage position.

6. The rowing machine of claim 1, wherein a first face of the hinge joint and a second face of the hinge joint are angled relative to a longitudinal axis of the beam.

7. The rowing machine of claim 1, wherein a pull mechanism is attached to the second section, the pull mechanism includes a pull handle; and a resistance mechanism is arranged to resist movement of the pull handle.

8. The rowing machine of claim 7, wherein the pull handle is connected to the resistance mechanism through a cable.

9. The rowing machine of claim 1, wherein a dampener comprises a first end attached to the first section of the beam and a second end attached to the second section of the beam.

10. The rowing machine of claim 1, wherein at least one of the first section or the second section of the beam comprises a fold handle.

11. The rowing machine of claim 10, wherein the first section or the second section is arranged to tilt upwards in response to an upward force applied to the fold handle when the rowing machine is in an upright position.

12. A rowing machine, comprising:

a frame, wherein the frame includes a first support, a second support, and a beam extending between the first support and the second support;

a track defined by at least a portion of the beam;

a sliding member movably disposed on the track;

a hinge joint disposed in the beam between the first support and the second support defining a first section of the beam and a second section of the beam;

a leg of the frame connected to the beam adjacent to the hinge joint;

an operating position where a first length of the first section of the beam is aligned with a second length of the second section of the beam; and a storage position where the first section of the beam is pivoted upwards such that the first section is over the hinge joint;

wherein the leg supports a weight of the upwardly pivoted first section and at least a portion of the second section when the rowing machine is in the storage position.

13. The rowing machine of claim 12, wherein the first section of the beam is pivoted upwards in the storage position when the rowing machine is in an upright position.

14. The rowing machine of claim 12, wherein a first face of the hinge joint and a second face of the hinge joint are angled with respect to a longitudinal axis of the beam.

15. The rowing machine of claim 12, wherein a pull mechanism is attached to the second section, the pull mechanism includes a pull handle; and a resistance mechanism is arranged to resist movement of the pull handle.

16. The rowing machine of claim 15, wherein the pull handle is connected to the resistance mechanism through a cable.

17. The rowing machine of claim 12, wherein a dampener comprises a first end attached to the first section of the beam and a second end attached to the second section of the beam.

18. The rowing machine of claim 12, wherein the first section or the second section of the beam comprises a fold handle.

19. The rowing machine of claim 18, wherein the first section or the second section is arranged to tilt upwards in response to an upward force applied to the fold handle when the rowing machine is in an upright position.

20. A rowing machine, comprising:

a frame, wherein the frame includes a first support, a second support, and a beam extending between the first support and the second support;

a track defined by at least a portion of the beam;

a sliding member movably disposed on the track;

a hinge joint disposed in the beam between the first support and the second support defining a first section of the beam and a second section of the beam;

a leg of the frame connected to the beam adjacent to the hinge joint;

an operating position where a first length of the first section of the beam is aligned with a second length of the second section of the beam;

a storage position where the first section of the beam is pivoted upwards such that the first section is over the hinge joint;

a pull mechanism attached to the second section, the pull mechanism includes a pull handle;

a resistance mechanism arranged to resist movement of the pull handle;

wherein the pull handle is connected to the resistance mechanism through a cable; and wherein the leg is configured to support both a weight of the upwardly pivoted first section and at least a portion of the second section when the rowing machine is in the storage position.

* * * * *